US009541048B2

(12) United States Patent
Okamoto et al.

(10) Patent No.: US 9,541,048 B2
(45) Date of Patent: Jan. 10, 2017

(54) FUEL INJECTION VALVE

(71) Applicant: Hitachi Automotive Systems, Ltd., Hitachinaka-shi, Ibaraki (JP)

(72) Inventors: Yoshio Okamoto, Tokyo (JP); Kazuki Yoshimura, Tokyo (JP); Noriyuki Maekawa, Tokyo (JP); Nobuaki Kobayashi, Hitachinaka (JP); Eiji Ishii, Tokyo (JP); Takahiro Saito, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 99 days.

(21) Appl. No.: 14/198,860

(22) Filed: Mar. 6, 2014

(65) Prior Publication Data

US 2014/0251263 A1 Sep. 11, 2014

(30) Foreign Application Priority Data

Mar. 8, 2013 (JP) ..... 2013-046088

(51) Int. Cl.

| | |
|---|---|
| ***F02M 63/00*** | (2006.01) |
| ***F02M 61/18*** | (2006.01) |
| ***F02M 61/16*** | (2006.01) |

(52) U.S. Cl.

CPC ..... *F02M 63/0078* (2013.01); *F02M 61/163* (2013.01); *F02M 61/184* (2013.01); *F02M 61/1853* (2013.01)

(58) Field of Classification Search

CPC ..... F02M 61/162; F02M 61/1853; F02M 61/1806; F02M 61/163; F02M 61/18; F02M 61/188; F02M 69/045; F02B 2023/108; F02D 2041/0015

(Continued)

(56) References Cited

U.S. PATENT DOCUMENTS 6,089,473 A * 7/2000 Keim ..... F02M 61/162 239/466
6,168,094 B1 * 1/2001 Schatz ..... F02M 51/0671 239/491

(Continued)

FOREIGN PATENT DOCUMENTS

JP 2000-508739 A 7/2000
JP 2003-336562 A 11/2003

(Continued)

OTHER PUBLICATIONS

Machine Translation of JP2004324596A, Published 2004, see "JP2004324596A_MachineTranslation.pdf".*

(Continued)

*Primary Examiner* — Long T Tran
(74) *Attorney, Agent, or Firm* — Crowell & Moring LLP

(57) ABSTRACT

A fuel injection valve realizing improved circumferential uniformity of swirling fuel is provided. The fuel injection valve includes a swirling chamber having an inner peripheral wall whose curvature is gradually larger from upstream to downstream, a path for swirling which, having a fuel flow-in region formed along a valve axis direction, guides fuel to the swirling chamber, and a fuel injection orifice open into the swirling chamber. In the fuel injection valve, the path for swirling is inclined toward the fuel injection orifice formed on a downstream side of the swirling chamber.

3 Claims, 9 Drawing Sheets

(58) Field of Classification Search
USPC ..... 123/306, 406.47, 431, 490, 262, 290, 123/294, 301, 296, 307; 239/11, 399, 463, 239/533.12, 500, 518, 491, 494
See application file for complete search history.

(56) References Cited

U.S. PATENT DOCUMENTS

| | | | | |
|---|---|---|---|---|
| 6,170,763 | B1 | 1/2001 | Fuchs et al. | |
| 6,695,229 | B1 * | 2/2004 | Heinbuch | F02M 61/162 239/491 |
| 6,783,085 | B2 * | 8/2004 | Xu | F02M 61/162 239/463 |
| 7,434,564 | B2 * | 10/2008 | Denger | F01L 3/06 123/275 |
| 2003/0221658 | A1 * | 12/2003 | Hiraya | F02B 23/10 123/279 |
| 2003/0234005 | A1 | 12/2003 | Sumisha et al. | |
| 2009/0230219 | A1 | 9/2009 | Matsumura et al. | |
| 2010/0288857 | A1 * | 11/2010 | Hashii | F02M 51/0682 239/585.1 |
| 2011/0168801 | A1 * | 7/2011 | Hubbard | F23R 3/286 239/11 |
| 2012/0017595 | A1 * | 1/2012 | Liu | F23D 14/02 60/737 |
| 2012/0193566 | A1 | 8/2012 | Yasukawa et al. | |
| 2013/0255640 | A1 * | 10/2013 | Okamoto | F02M 69/04 123/478 |

FOREIGN PATENT DOCUMENTS

| | | | |
|---|---|---|---|
| JP | 2004324596 | A * | 11/2004 |
| JP | 2007-309236 | A | 11/2007 |
| JP | 2012-158995 | A | 8/2012 |

OTHER PUBLICATIONS

Japanese Office Action issued in counterpart Japanese Application No. 2013-046088 dated Aug. 4, 2015, with English translation (Six (6) pages).

* cited by examiner

FUEL INJECTION VALVE

CLAIM OF PRIORITY

The present application claims priority from Japanese application serial no. 2013-046088, filed on Mar. 8, 2013, the content of which is hereby incorporated by reference into this application.

FIELD OF THE INVENTION

The present invention relates to a fuel injection valve for use in an internal combustion engine and, more particularly, to a fuel injection valve capable of spraying swirling fuel to improve fuel atomization performance.

BACKGROUND OF THE INVENTION

An example of fuel injection valve using a known technique is disclosed in Japanese Unexamined Patent Publication No. 2003-336562. In the technique, atomization of fuel injected from plural fuel injection orifices is promoted making use of a swirling fuel flow.

The fuel injection valve has a valve seat member in which a downstream end of a valve seat cooperating with a valve element has opening formed through the front end surface of the valve seat member and an injector plate joined to the front end surface of the valve seat member. Between the valve seat member and the injector plate, lateral paths and swirling chambers are formed. The lateral paths communicate with the downstream end of the valve seat. The downstream ends of the lateral paths are communicated with the swirling chambers in the tangential directions of the swirling chambers. The injector plate has fuel injection orifices formed therethrough for injecting fuel swirled in the swirling chambers. Each of the fuel injection orifices is shifted by a predetermined distance from the center of the associated swirling chamber toward the upstream end side of the associated lateral path.

The structure described above can effectively promote atomization of fuel injected from each fuel injection orifice.

The fuel injection valve described in Japanese Translation of PCT International Application Publication No. 2000-508739 has a valve seat member including a stationary valve seat, a valve closing member which cooperates with the valve seat member and which can move along the longitudinal axis of the valve, and a circular plate which includes a hole and which is disposed downstream of the valve seat. The circular plate having a hole has at least one flow-in area and at least one flow-out opening. The upper functional plane having at least one flow-in area differs in opening geometry in a cross-sectional view from the lower functional plane having at least one flow-out opening. In the fuel injection valve, the lower end surface of the valve seat member partly and directly covers at least one flow-in area of the circular plate causing at least two flow-out openings to be covered by the valve seat member.

In the structure described above, S-shaped drifting is realized in the fuel flow for fuel atomization improvement, so that a highly-atomized fuel spray shape is obtained.

SUMMARY OF THE INVENTION

To inject, from each fuel injection orifice, swirling fuel in which the swirling intensity is substantially symmetric in the circumferential direction of swirling (highly uniform in the circumferential direction), it is necessary to make the fuel swirling in an outlet portion of each fuel injection orifice substantially symmetric (highly uniform in the circumferential direction). For this, it is necessary to properly design fuel flow path shapes including the shapes of swirling chambers and lateral fuel paths (fuel paths for swirling). Particularly, the total volume of fuel flow paths affects the accuracy of fuel injection characteristics (the accuracy deteriorates when the total volume is large). Hence, it is necessary to minimize the total volume of fuel flow paths and increase the uniformity of fuel flow in the circumferential direction in each fuel swirling chamber.

In the existing techniques described in the above patent documents, the fuel coming in along the valve axis direction reaches swirling chambers via lateral paths extending perpendicularly to the valve axis direction. In the above flow path structure, the fuel flow direction abruptly changes in the inlet portion of each lateral path, making the fuel flow uneven as observed in a cross-sectional plane of the flow path. When such an uneven flow of fuel enters each swirling chamber without being adequately rectified, part of the fuel is caused to rapidly flow toward the associated fuel injection orifice, possibly impairing the substantial symmetry (high circumferential uniformity) of the swirling fuel flow.

The present invention has been made in view of the above circumstances, and an object of the present invention is to provide a fuel injection valve which can improve the circumferential uniformity of swirling fuel.

To achieve the above object, the fuel injection valve according to the present invention includes a slidably installed valve element; a nozzle body having a valve seat surface formed thereon where the valve element is seated when the valve is closed and an opening formed on a downstream side of a fuel flow; a path for swirling communicated with the opening of the nozzle body and formed, relative to the nozzle body, on a downstream side of the fuel flow; a swirling chamber formed, relative to the path for swirling, on a downstream side of the fuel flow, the swirling chamber having a cylindrical inner surface and swirling fuel therein thereby providing the fuel with a swirling force; and a fuel injection orifice cylindrically formed at a bottom of the swirling chamber to outwardly spray fuel. In the fuel injection valve, the path for swirling is provided inclinedly toward the fuel injection orifice.

According to the present invention, the circumferential uniformity of each swirling fuel flow is increased, forming fuel like a thin film is promoted, and the fuel is finely atomized.

DETAILED DESCRIPTION OF THE PREFERRED EMBODIMENT

Figure 1:
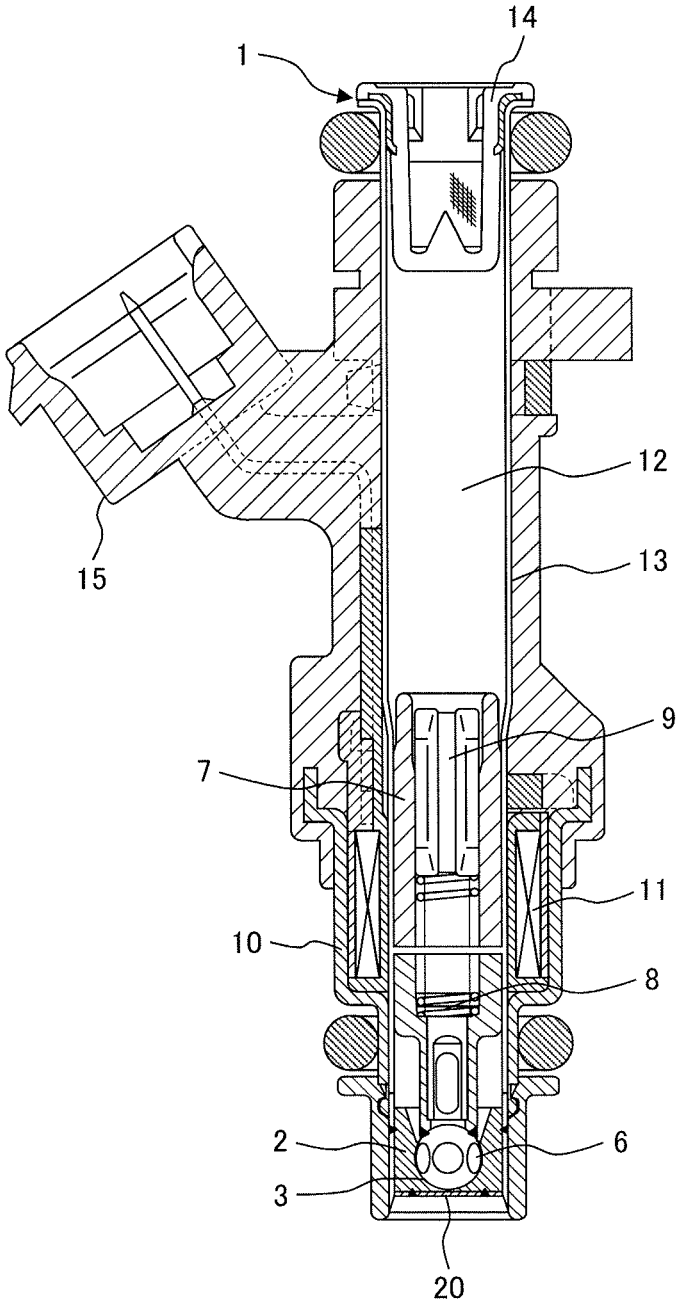
FIG. 1 is a longitudinal sectional view taken along the valve axis of a fuel injection valve according to an embodiment of the present invention and represents an overall structure of the fuel injection valve.

An embodiment of the present invention will be described below with reference to FIGS. 1 to 6. FIG. 1 is a longitudinal sectional view taken along the valve axis of a fuel injection valve 1 according to an embodiment of the present invention and represents an overall structure of the valve.

Referring to FIG. 1, in the fuel injection valve 1, a thin-walled, stainless-steel pipe 13 accommodates a nozzle body 2 and a valve element 6, and the valve element 6 is reciprocally moved (for opening/closing operation) by an electromagnetic coil 11 disposed outside the valve element 6. In the following, the structure of the fuel injection valve 1 will be described in detail.

Figure 2:
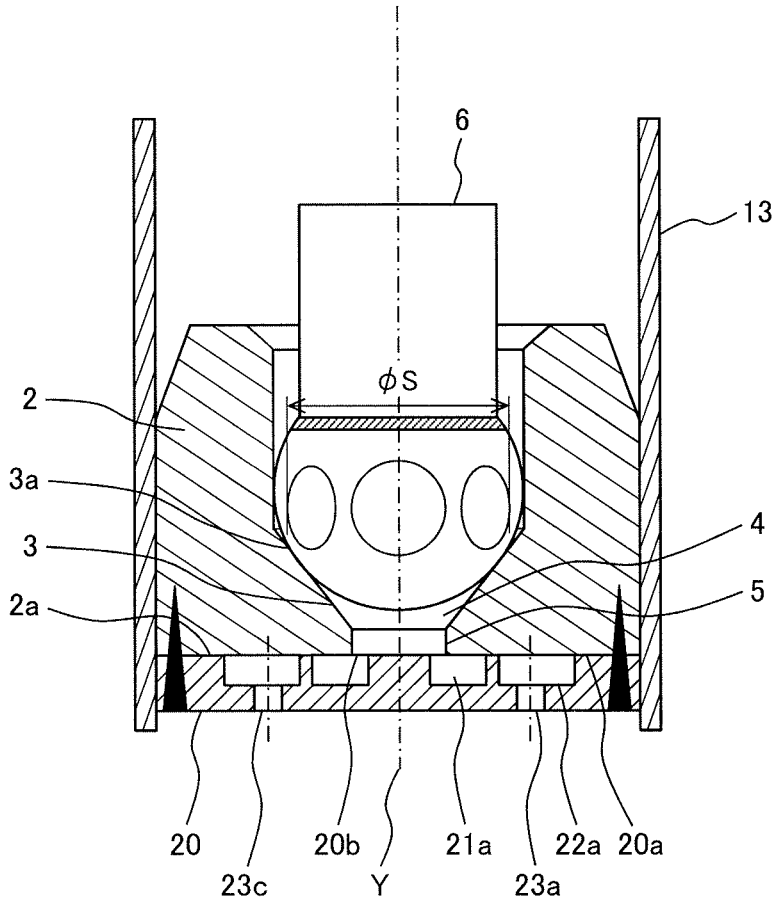
FIG. 2 is a vertical sectional view of a nozzle body and its vicinity in the fuel injection valve according to the embodiment of the present invention.
Figure 3:
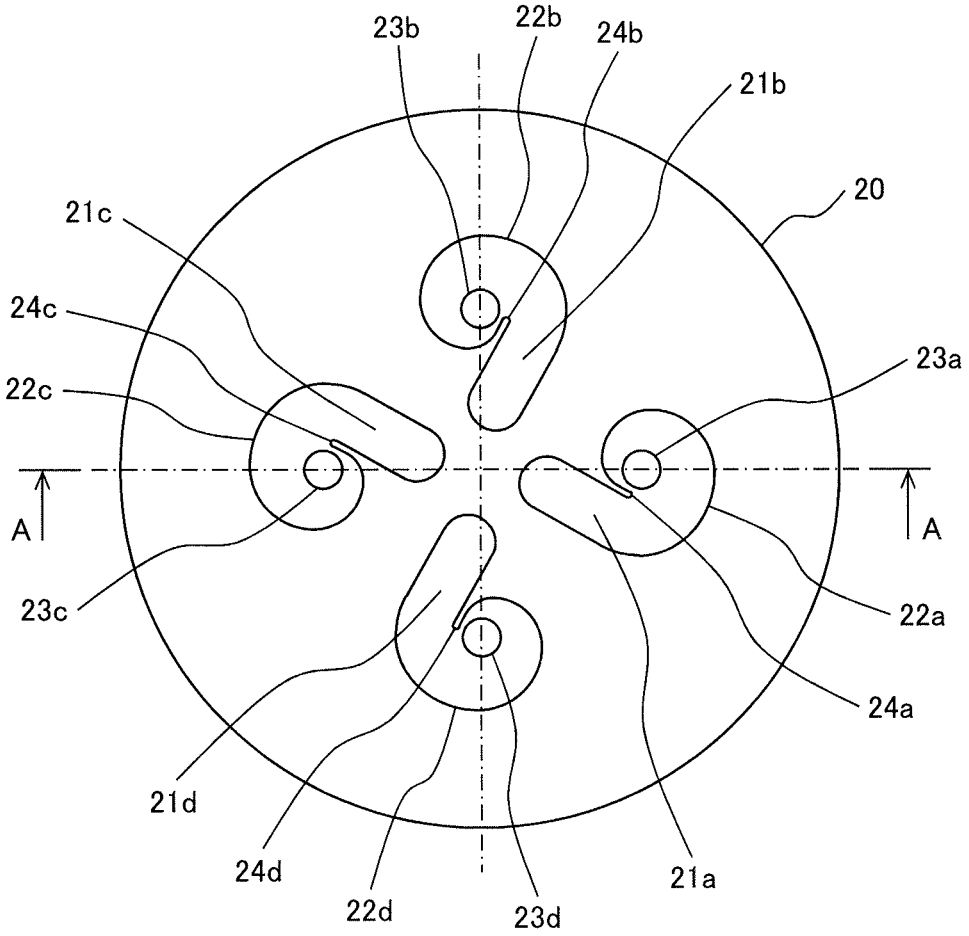
FIG. 3 is a plan view of an orifice plate disposed in a lower end portion of the nozzle body included in the fuel injection valve according to the embodiment of the present invention.
Figure 4:
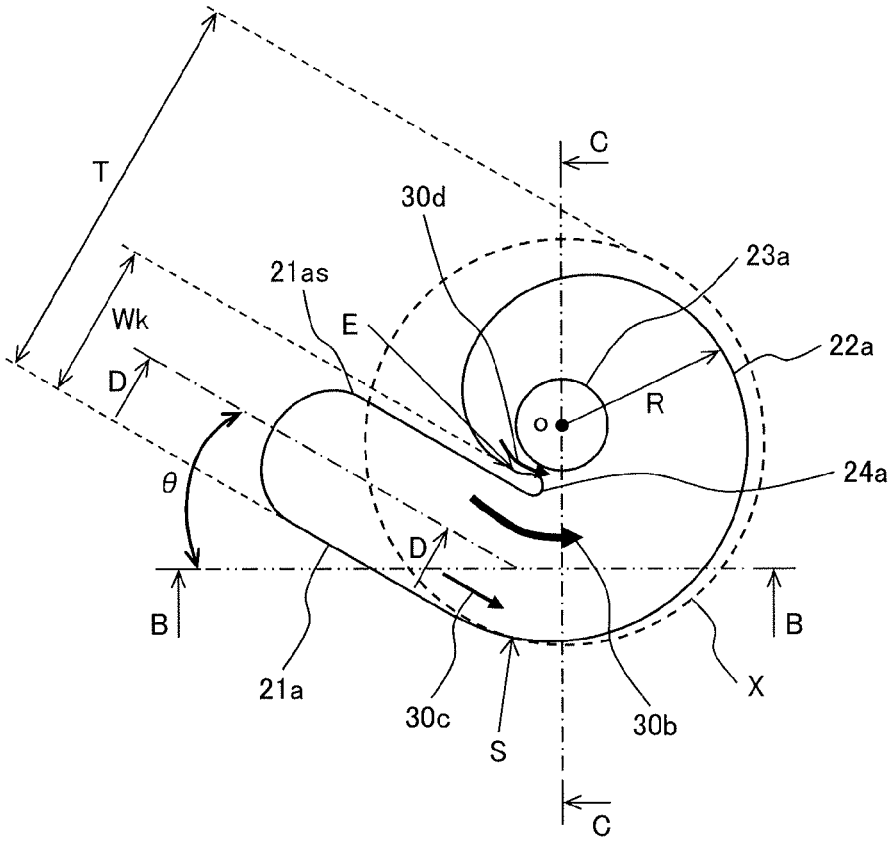
FIG. 4 is an enlarged partial view showing an inclined structure of a path for swirling included in the fuel injection valve according to the embodiment of the present invention.

The fuel injection valve 1 includes a magnetic yoke 10 surrounding the electromagnetic coil 11, a core 7 centrally positioned in the electromagnetic coil 11 with one end thereof magnetically connected to the yoke 10, a valve element 6 which can be lifted by a predetermined distance, a valve seat surface 3 which is brought into contact with the valve element 6, a fuel injection chamber 4 which allows fuel flowing between the valve element 6 and the valve seat surface 3 to pass therethrough, and an orifice plate 20 positioned downstream of the fuel injection chamber 4 with plural fuel injection orifices 23*a*, 23*b*, 23*c*, and 23*d* formed therethrough (see FIGS. 2 to 4).

The core 7 is provided with a spring 8 centrally disposed therein as an elastic member to press the valve element 6 against the valve seat surface 3. The elastic force of the spring 8 is adjusted by the distance by which a spring adjustor 9 is shifted toward the valve seat surface 3.

When the coil 11 is not energized, the valve element 6 and the valve seat surface 3 are kept tightly in contact with each other. In this state, the fuel path is closed, so that the fuel in the fuel injection valve 1 stays there and so that no fuel is injected through the fuel injection orifices 23*a*, 23*b*, 23*c*, and 23*d*.

When the coil 11 is energized, an electromagnetic force is applied to the valve element 6 causing the valve element 6 to move until it comes into contact with an opposing lower end surface of the core 7.

In this valve-open state, there is a gap between the valve element 6 and the valve seat surface 3, i.e. a fuel path is formed, allowing fuel to be injected through the fuel injection orifices 23*a*, 23*b*, 23*c*, and 23*d*.

The fuel injection valve 1 includes a fuel path 12 which is provided with a filter 14 installed at an inlet portion thereof. The fuel path 12 includes a through-hole portion centrally extending through the core 7 to guide the fuel pressurized by a fuel pump, not shown, to the fuel injection orifices 23*a*, 23*b*, 23*c*, and 23*d* via the inside of the fuel injection valve 1. The exterior of the fuel injection valve 1 is covered by an electrically insulating resin mold 15.

As described above, the fuel injection valve 1 controls the amount of fuel supply by reciprocating the valve element 6 between its open and closed positions. This is done by controlling energization/de-energization (using injection pulses) of the coil 11. The fuel injection valve 1, particularly, the valve element 6 used to control the amount of fuel supply is designed not to cause fuel leakage in a closed state thereof in particular.

The valve element 6 used in this type of fuel injection valve includes a mirror-finished ball with high circularity (steel ball for ball bearing based on JIS) which can improve the valve element seat ability. The angle of the valve seat surface 3 with which the ball is to come into tight contact ranges from 80 to 100 degrees which are optimum to facilitate valve seat grinding to achieve high circularity. This makes it possible to maintain very high ball seat ability on the valve seat surface 3. The nozzle body 2 that includes the valve seat surface 3 has high hardness achieved by quenching and is, having undergone demagnetization treatment, free of unwanted magnetism. The valve element 6 structured as described above enables fuel injection amount control free of fuel leakage. Thus, a valve element structure with high cost performance is realized.

FIG. 2 is a vertical sectional view of the nozzle body 2 and its vicinity in the fuel injection valve according to the present embodiment. As shown in FIG. 2, an upper surface 20*a* of the orifice plate 20 is in contact with an under surface 2*a* of the nozzle body 2. The outer periphery of the portion in contact with the nozzle body 2 of the orifice plate 20 is fixed by laser welding to the nozzle body 2. In FIG. 2, the orifice plate 20 is shown in a sectional view in the direction of arrows A in FIG. 3.

In the description of the present embodiment, the up-down direction is based on FIG. 1. Namely, in the valve axis direction of the fuel injection valve 1, the fuel path 12 side is the upper side, and the side with the fuel injection orifices 23*a*, 23*b*, 23*c*, and 23*d* provided is the lower side.

A fuel inlet hole 5 whose diameter is smaller than diameter $\phi S$ of a seating portion 3*a* of the valve seat surface 3 is provided in a lower end portion of the nozzle body 2. The valve seat surface 3 is conically shaped and the fuel inlet hole 5 is centrally formed at a downstream end of the valve seat surface 3.

The valve seat surface 3 and the fuel inlet hole 5 are formed to be coaxial with the valve axis Y. With the fuel inlet hole 5 formed as described above, flow-in openings 20*b* communicated with the corresponding downstream fuel paths are formed where the under surface 2*a* of the nozzle body 2 and the upper surface 20*a* of the orifice plate 20 are in contact with each other.

The structure of the orifice plate 20 will be described below with reference to FIG. 3. FIG. 3 is a plan view of the orifice plate 20 disposed in a lower end portion of the nozzle body 2 included in the fuel injection valve 1 according to the present embodiment.

The orifice plate 20 has four paths for swirling 21*a*, 21*b*, 21*c*, and 21*d* which are radially spaced a predetermined distance from the center of the orifice plate 20 and extend radially outwardly while being circumferentially equidistantly spaced from one another (to be 90 degrees apart). The paths for swirling 21*a*, 21*b*, 21*c*, and 21*d* are concave fuel paths formed on the upper surface 20*a* of the orifice plate 20.

The path for swirling 21*a* is formed to communicate, at a downstream end thereof, with a swirling chamber 22*a*. The path for swirling 21*b* is formed to communicate, at a downstream end thereof, with a swirling chamber 22*b*. The path for swirling 21*c* is formed to communicate, at a downstream end thereof, with a swirling chamber 22*c*. The path for swirling 21*d* is formed to communicate, at a downstream end thereof, with a swirling chamber 22*d*.

The paths for swirling 21*a*, 21*b*, 21*c*, and 21*d* are for supplying fuel to the swirling chambers 22*a*, 22*b*, 22*c*, and 22*d*, respectively. In this sense, the paths for swirling 21*a*, 21*b*, 21*c*, and 21*d* may be referred to as swirling fuel supply paths 21*a*, 21*b*, 21*c*, and 21*d*.

The swirling chambers 22*a*, 22*b*, 22*c*, and 22*d* are formed such that their walls are, in the upstream-to-downstream direction, gradually larger in curvature (gradually smaller in curvature radius). The curvature may continuously increase, or it may increase in stages to be constant in each of predetermined ranges.

Typical examples of curves whose curvatures are gradually larger from upstream to downstream include, for example, involute curves (shapes), spiral curves (shapes), and curves formed based on a design technique for centrifugal blowers. Even though the present embodiment is described using a spiral curve as an example, the description also applies to cases where a different curve, for example, one of those mentioned above whose curvature is gradually larger from upstream to downstream is adopted.

Figure 5:
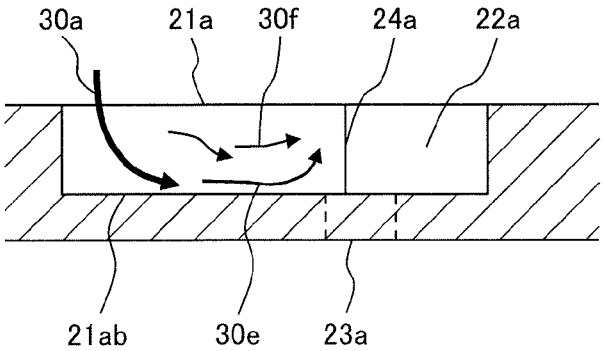
FIG. 5 is a sectional view in the direction of arrows D in FIG. 4.
Figure 6:
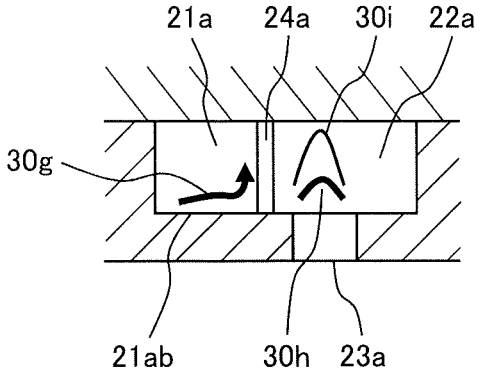
FIG. 6 is a sectional view in the direction of arrows C in FIG. 4.

Next, with reference to FIGS. 4 to 6, how the path for swirling 21*a* and the swirling chamber 22*a* according to the present embodiment are formed and their relationships with the fuel injection orifice 23*a* will be described.

FIG. 4 is a partial enlarged view for describing relationships between the path for swirling 21*a* having an inclined structure and each of the swirling chamber 22*a* and the fuel injection orifice 23*a*. FIG. 5 is a sectional view in the direction of arrows D in FIG. 4 for describing fuel flows in the path for swirling 21*a*. FIG. 6 is a sectional view in the direction of arrows C in FIG. 4 for describing fuel flows in the path for swirling 21*a* and the swirling chamber 22*a*. The path for swirling 21*a* is open to, i.e. communicated with, the swirling chamber 22*a* in the tangential direction of the swirling chamber 22*a* forming a desired angle θ shown in FIG. 4. The fuel injection orifice 23*a* is open in a central portion of swirling of the swirling chamber 22*a*.

As described in the foregoing, according to the present embodiment, the inner peripheral wall of the swirling chamber 22*a* is formed to be spiral, as seen on a plane (in a planar sectional view) perpendicular to the valve center axis. The characteristic structure of the swirling chamber 22*a* that is formed spirally will be briefly described below.

The swirling chamber 22*a* and the path for swirling 21*a* are designed such that, in a planar view, the line extended from (line tangential to) the inner wall of the swirling chamber 22*a* and the line extended from a side wall 21 as of the path for swirling 21*a* do not intersect on the swirling chamber 22 side. There is a thickness forming part 24*a* formed between the end of the inner wall of the swirling chamber 22*a* and the side wall 21 as of the path for swirling 21*a*. The thickness forming part 24*a* is required in forming the swirling chamber 22*a* and the path for swirling 21*a*.

The spiral curve of the spirally formed inner wall of the swirling chamber 22*a* has a point of origin (it may be said to be a point of termination in the present embodiment) which coincides with the center of the fuel injection orifice 23*a*. Hence, the center of the swirling fuel flow along the spiral inner wall of the swirling chamber 22*a* coincides with the center of the fuel injection orifice 23*a*. Furthermore, referring to FIG. 4, the inner peripheral wall of the swirling chamber 22*a* is designed using the following arithmetic spiral equations (1) and (2). The center o of a reference circle X for drawing an arithmetic spiral, the center o based on which the swirling chamber 22*a* is formed, and the center o of the fuel injection orifice 23*a* mutually coincide.

$$R=D/2\times(1-a\times\theta) \quad (1)$$

$$a=Wk/(D/2)/(2\pi) \quad (2)$$

where R is the distance between the center o based on which the swirling chamber 22*a* is formed and the inner peripheral wall of the swirling chamber 22*a*, D is the diameter of the reference circle X for drawing an arithmetic spiral, and Wk is the distance between the ending point E and the starting point S of the swirling chamber 22*a*.

The path for swirling 21*a* has a rectangular cross-section to allow fuel to flow through. Though not illustrated, the width and height of the rectangular cross-section are determined by selecting appropriate values meeting specification requirements out of various data obtained by making experiments beforehand based on the diameter of the fuel injection orifice 23*a* and the diameter of the reference circle used as a size reference for the swirling chamber 22*a*. Namely, they are selected according to the flow rate and injection angle requirements on the fuel injection valve.

Figure 8:
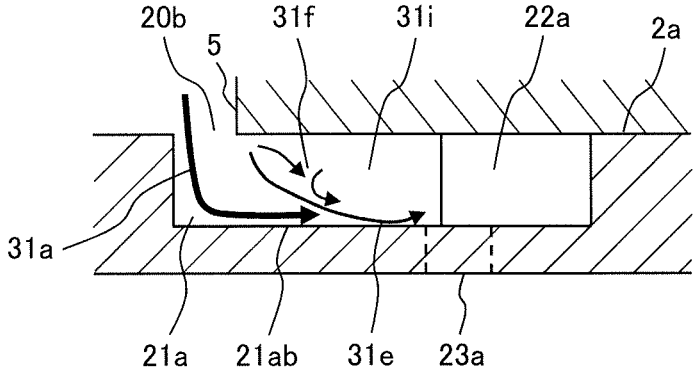
FIG. 8 is a sectional view in the direction of arrows F in FIG. 7.
Figure 9:
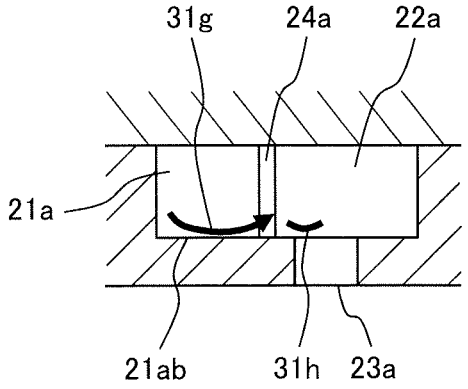
FIG. 9 is a sectional view in the direction of arrows E in FIG. 7.

In the following, an inclined structure used in the present embodiment and its effects will be described. First, with reference to FIGS. 7 to 9 schematically showing characteristic portions of a path for swirling 21*a* having no inclined portion, the flow of fuel in such a path will be described based on the results of analysis conducted by the present inventors.

Figure 7:
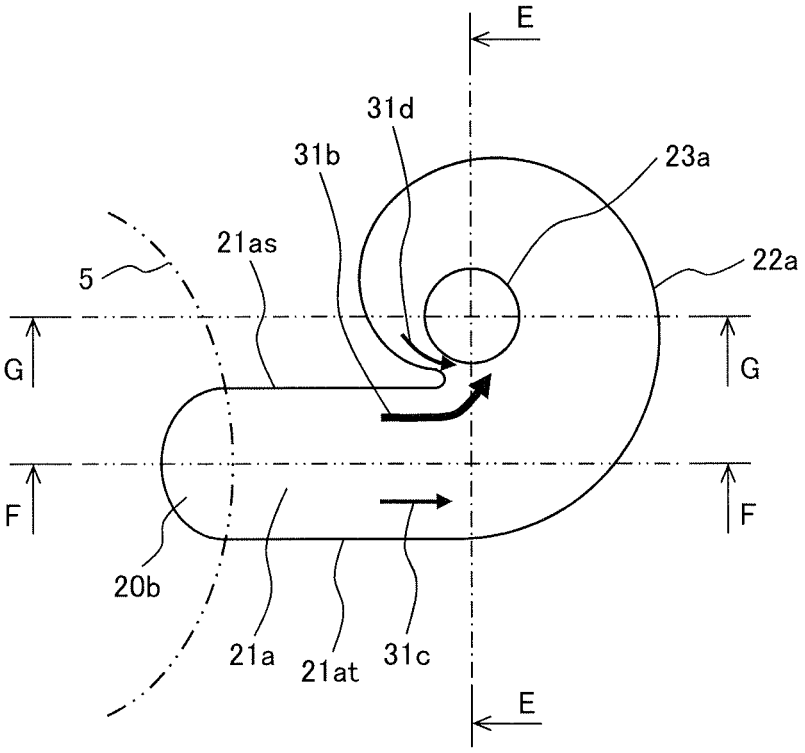
FIG. 7 is an enlarged partial plan view for describing the flow of fuel in a path for swirling and a swirling chamber included in an existing orifice plate.

FIG. 7 is an enlarged partial plan view for describing the flow of fuel in the path for swirling 21*a* and the swirling chamber 22*a* included in the orifice plate 20. FIG. 8 is a sectional view in the direction of arrows F in FIG. 7 and is for describing characteristic portions of the fuel flow as observed in the longitudinal direction of the path for swirling 21*a*. FIG. 9 is a sectional view in the direction of arrows E in FIG. 7 and is for describing characteristic portions of the fuel flow as observed in the height direction of the path for swirling 21*a* and the swirling chamber 22*a*.

The fuel flowing in the path for swirling 21*a* tends to flow, on the inlet side of the swirling chamber 22*a*, toward the fuel injection orifice 23*a*. Therefore, in terms of the fuel flow distribution in the width direction of the path for swirling 21*a*, a fast flow 31*b* is formed on the side wall 21 as side of the path for swirling 21*a* compared with the side wall 21 at side and a slow flow 31*c* is formed on the side wall 21 at side compared with the side wall 21 as side.

The flows 31*b* and 31*c* are generated when a flow 31*a* in the valve axis direction hits, after flowing in through a flow-in opening 20*b*, a bottom surface 21*ab* of the path for swirling 21*a* to be perpendicularly bent there. The flow-in opening 20*b* is an approximately semicircular gap formed between the opening of the fuel inlet hole 5 and the orifice plate 20.

Figure 10:
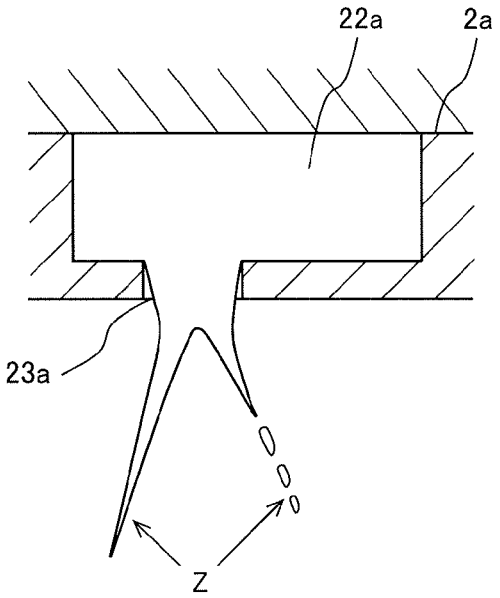
FIG. 10 is a sectional view in the direction of arrows G in FIG. 7.

As shown in FIG. 8, after hitting the bottom surface 21*ab* of the path for swirling 21*a*, the flow 31*a* is slowed down while flowing in the longitudinal direction of the path for swirling 21*a* and is changed into a slowed-down flow 31*e*, but the fuel flowing toward the height direction of the swirling chamber 22*a* cannot form a flow strong enough to generate an adequate swirling effect. A flow 31*f* flowing toward the bottom of the path for swirling 21*a* is a flow induced by the flow 31*e*. It consequently forms a stagnant flow region 31*i*. Referring to FIG. 9, at the inlet portion of the swirling chamber 22*a*, a flow 31*g* formed along the bottom surface 21*ab* of the path 21*a* for swirling flows to the thickness forming part 24*a* side of the swirling chamber 22*a*. As a result, the flow 31*g* strongly interferes with a flow 31*d* (see FIG. 7) on the fuel injection orifice 23*a* side. This interference results in generating, in the inlet portion of the fuel injection orifice 23*a*, a flow 31*h* of a widely different speed, impairing the fuel flow symmetry (the uniformity of swirling fuel flow). This makes a spray Z from the fuel injection orifice 23*a* asymmetrical as shown in FIG. 10.

The inclined structure of the path for swirling 21*a* according to the present embodiment suppresses generation of such an unwanted sharp flow and also rectifies the fuel flow in the inlet portion of the swirling chamber 22*a* in the height direction of the swirling chamber 22*a*. Reverting to FIGS. 4 to 6, the inclined structure of the path for swirling 21*a* and the fuel flow therein will be described.

The path for swirling 21*a* is inclined toward the fuel injection orifice 23*a* by a desired angle θ with respect to the inlet portion of the swirling chamber 22*a*. Namely, referring to FIG. 4, center line D-D of the path for swirling 21*a* is inclined by angle θ with respect to line segment B-B perpendicularly crossing line segment C-C passing through the center of the fuel injection orifice 23*a*. The inclination angle θ is preferably in the range of 10° to 30°. A flow 30*a* flowing in along the valve axis direction forms, after hitting the bottom 21*ab* of the path for swirling 21*a*, flows 30*b* and 30*c* which head for the inner peripheral wall near an inlet portion of the swirling chamber 22*a*. The flow 30*b* being closer to the fuel injection orifice 23*a* than the flow 30*c* flows faster than the flow 30*c*. In this manner, interference between the fast flow 30*b* and a flow 30*d* having swirled in the swirling chamber 22*a* can be avoided, so that the fuel flowing in the swirling chamber 22*a* can be adequately swirled. Also, as shown in FIG. 5, a flow 30*e* heading toward the inlet portion of the swirling chamber 22*a* is rectified toward the height direction of the path for swirling 21*a*. Therefore, unlike in existing cases, no large stagnant flow area like the one denoted as 31*i* in FIG. 8 is generated. With the fuel flow speed in the height direction recovered in the swirling chamber 22*a* as shown in FIG. 6, the fuel flowing in the swirling chamber 22*a* reaches the fuel injection orifice 23*a* after being adequately swirled. This improves the swirling flow symmetry in the outlet portion of the fuel injection orifice 23*a*.

Figure 12:
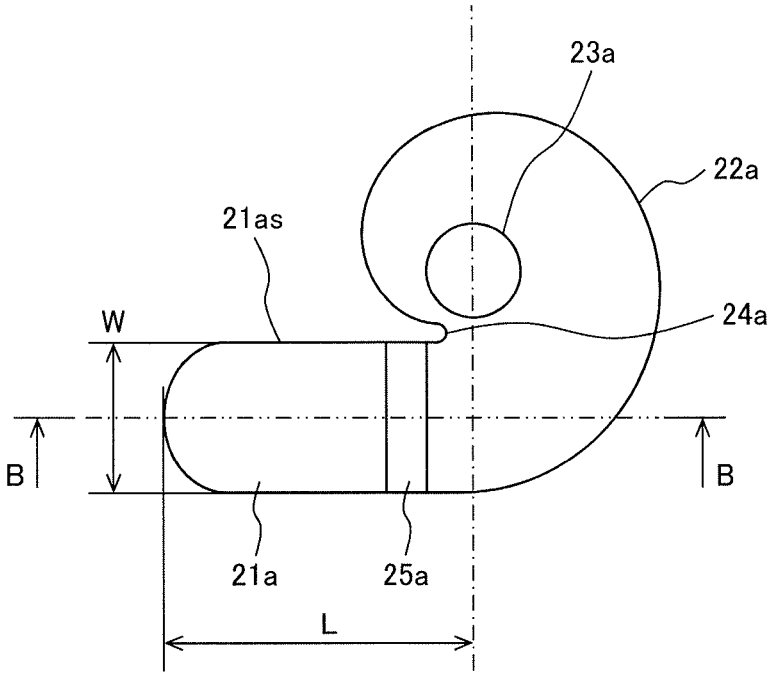
FIG. 12 is an enlarged partial plan view showing a projecting part formed on a bottom portion of a path for swirling included in the fuel injection valve according to the embodiment of the present invention.

As shown in FIG. 12, a projecting part 25*a* is formed to extend over the entire width W of the path for swirling 21*a*. Length b, in the longitudinal direction of the path for swirling 21*a*, of the projecting part 25*a* does not exceed ⅓ of length L of the path for swirling 21*a*.

Figure 13:
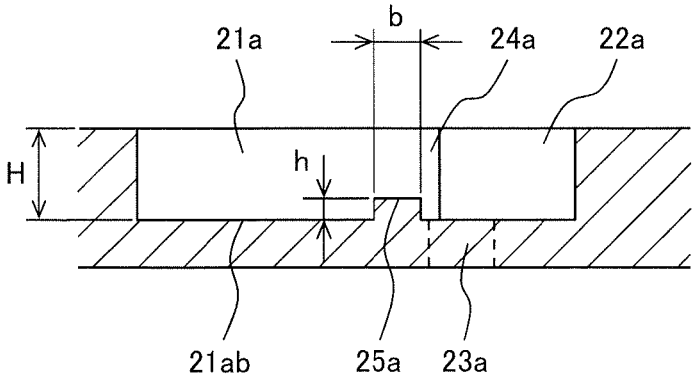
FIG. 13 is a sectional view in the direction of arrows B in FIG. 12.

Referring to FIG. 13, height h, in the height direction of the path for swirling 21*a*, of the projecting part 25*a* does not exceed ⅙ of height H of the path for swirling 21*a*. The projecting part 25*a* is formed on the downstream side of the path for swirling 21*a* (on the inlet side of the swirling chamber 22*a*).

Figure 11:
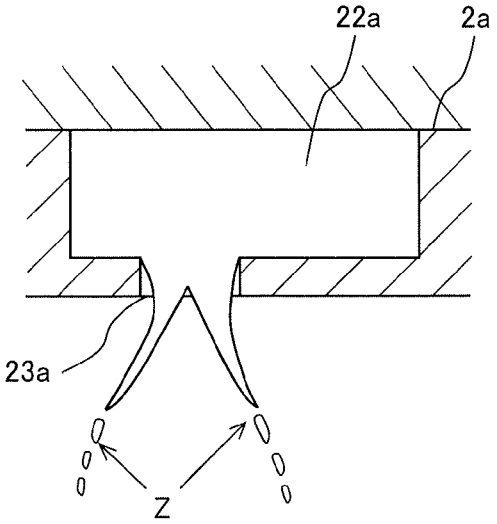
FIG. 11 is a sectional view in the direction of arrows G in FIG. 7.
Figure 14:
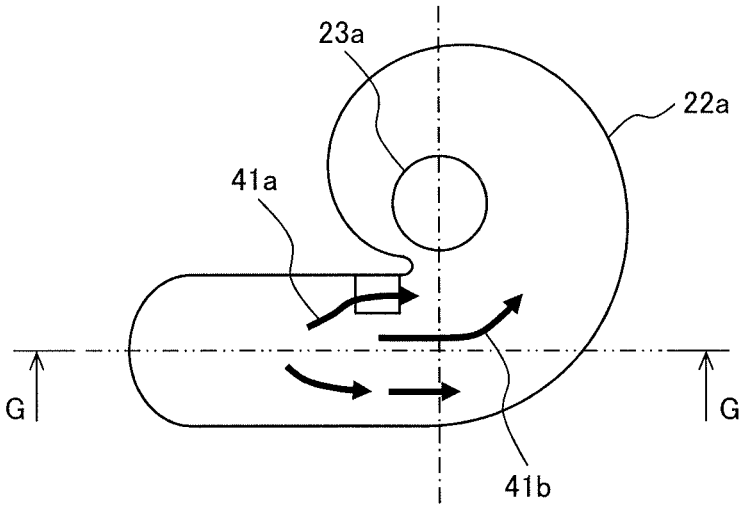
FIG. 14 is an enlarged partial plan view for describing the flow of fuel in a path for swirling and a swirling chamber included in the orifice plate included in the fuel injection valve according to the embodiment of the present invention.
Figure 15:
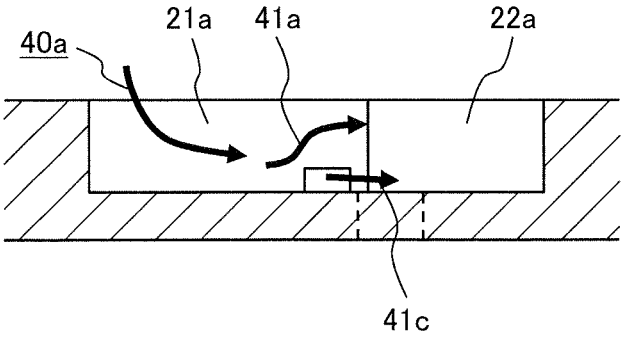
FIG. 15 is a sectional view in the direction of arrows G in FIG. 14.

In the structure described above, the fuel entering the path for swirling 21*a* through the flow-in opening 20*b* flows, as shown in FIGS. 14 and 15, from the bottom 21*ab* of the path for swirling 21*a* toward the upper side of the swirling chamber 22*a* to be rectified toward the height direction of the swirling chamber 22*a* (41*a* and 41*b*). In this way, the fuel flowing in the swirling chamber 22*a* is adequately swirled, then reaches the fuel injection orifice 23*a*. This makes the swirling flow symmetric in the outlet portion of the fuel injection orifice 23*a*. As a result, the symmetry of the fuel spray from the fuel injection orifice 23*a* is improved as shown in FIG. 11.

Though not illustrated, the nozzle body 2 and the orifice plate 20 are structured such that they can be positioned with ease in a simple manner using, for example, jigs. This enhances dimensional accuracy when they are assembled. The orifice plate 20 is formed by pressing (plastic forming) advantageous for mass-production. Possible alternative forming methods include electro-discharge machining, electroforming, and etching which can achieve high forming accuracy without applying much stress to the object being formed. With the nozzle body 2 and the orifice plate 20 structured as described above, their production costs are lowered and, with their workability improved, their dimensional variations are reduced. This greatly improves the robustness of the shape and volume of fuel spray generated by the fuel injection valve.

As described above, the fuel injection valve according to an embodiment of the present invention has paths for swirling each inclined with respect to the associated swirling chamber. This serves to suppress interference between the fuel flowing out of each path for swirling and the fuel swirled in the associated swirling chamber and causes the fuel flow to be rectified as observed in a sectional view (in the width and height directions) of each path for swirling. Particularly, the fuel out of each path for swirling enters the inlet portion of the associated swirling chamber where its flow speed is adequately distributed in the height direction of the swirling chamber and is then fed into the swirling chamber. In the swirling chamber, the fuel flows being guided by the spirally formed inner peripheral wall of the swirling chamber, so that the fuel is adequately swirled. In the inlet portion of a fuel injection orifice positioned to be at the center of the swirling fuel, a circumferentially uniformly swirling fuel flow is formed. This promotes causing the fuel to be formed like a thin film.

Furthermore, with the thickness forming parts also provided, the collision between the fuel flowing in each path for swirling and the fuel flowing in the associated swirling chamber is reduced. This further promotes forming a circumferentially uniformly swirling fuel flow and causing the fuel to be formed like a thin film.

A fuel spray formed like a uniformly thin film as described above actively exchanges energy with surrounding air, so that its breakup is promoted immediately after being sprayed. This realizes a finely atomized fuel spray.

What is claimed is:

1. A fuel injection valve, comprising: a slidably installed valve element; a nozzle body having a valve seat surface formed thereon where the valve element is seated when the valve is closed and an opening formed on a downstream side of a fuel flow; a path for swirling communicated with the opening of the nozzle body and formed, relative to the nozzle body, on a downstream side of the fuel flow; a swirling chamber formed, relative to the path for swirling, on a downstream side of the fuel flow, the swirling chamber having a cylindrical inner surface and swirling fuel therein thereby providing the fuel with a swirling force; and a fuel injection orifice cylindrically formed at a bottom of the swirling chamber to outwardly spray fuel, wherein the swirling chamber is provided inclinedly toward the fuel injection orifice, so that a longitudinal axis of the path for swirling intersects a line that passes through a center of the opening and a center of the fuel injection orifice, wherein the path for swirling has walls that are straight, the straight walls of the path for swirling defining a projection, the fuel injection orifice has walls that are straight, the straight walls of the fuel injection orifice defining another projection; the entire another projection of the fuel injection orifice does not intersect the projection defined by the path for swirling along both a width direction of the fuel injection valve and a longitudinal direction of the fuel injection valve.

2. The fuel injection valve according to claim 1, wherein a thickness forming part is provided between the swirling chamber and the path for swirling.

3. The fuel injection valve according to claim 1, wherein the swirling chamber directly overlaps the fuel injection orifice, and the path for swirling is offset from the fuel injection orifice, so that the path for swirling does not directly overlap the fuel injection orifice along the width direction of the fuel injection valve, and along the length direction of the fuel injection valve.

* * * * *